US006533436B2

(12) United States Patent
Krietzman et al.

(10) Patent No.: US 6,533,436 B2
(45) Date of Patent: Mar. 18, 2003

(54) THIN FLAT ILLUMINATOR

(76) Inventors: Mark Howard Krietzman, P.O. Box 3185, Palos Verdes, CA (US) 90274; Yu-Hsin Chen, P.O. Box 3185, Palos Verdes, CA (US) 90274

( * ) Notice: Subject to any disclaimer, the term of this patent is extended or adjusted under 35 U.S.C. 154(b) by 0 days.

(21) Appl. No.: 09/852,228

(22) Filed: May 8, 2001

(65) Prior Publication Data

US 2001/0040801 A1 Nov. 15, 2001

Related U.S. Application Data

(60) Provisional application No. 60/202,894, filed on May 10, 2000, and provisional application No. 60/253,188, filed on Nov. 27, 2000.

(51) Int. Cl.[7] ..... F21L 4/00
(52) U.S. Cl. ..... 362/200; 362/183
(58) Field of Search ..... 362/200, 208, 362/189, 800, 253, 205

(56) References Cited

U.S. PATENT DOCUMENTS

| | | | | | |
|---|---|---|---|---|---|
| 4,677,835 | A | | 7/1987 | Almblad | 70/456 R |
| 4,959,983 | A | | 10/1990 | Hsu | 70/456 R |
| 5,046,343 | A | | 9/1991 | Miwa | 70/408 |
| 5,386,351 | A | * | 1/1995 | Tabor | 362/200 |
| 5,544,510 | A | | 8/1996 | Botteon et al. | 70/456 R |
| 5,927,846 | A | | 7/1999 | Sinclair | 362/189 |
| 6,039,454 | A | | 3/2000 | Hallgrimsson | 362/200 |
| 6,070,990 | A | | 6/2000 | Dalton et al. | 362/189 |
| 6,109,762 | A | | 8/2000 | Hallgrimsson et al. | 362/200 |
| 6,299,323 | B1 | * | 10/2001 | Yu et al. | 362/200 |
| 6,394,621 | B1 | * | 5/2002 | Hanewinkel, III | 362/200 |
| 6,435,695 | B1 | * | 8/2002 | Altman | 362/200 |

* cited by examiner

*Primary Examiner*—Laura K. Tso
(74) *Attorney, Agent, or Firm*—Mark Krietzman

(57) ABSTRACT

A flat illuminator, which may utilize a plurality of batteries and may support multiple LED illumination sources, adapted for high volume assembly with a momentary on/off switch formed therein. Encoded data and/or a key blank may also be combined with the flat illuminator.

36 Claims, 8 Drawing Sheets

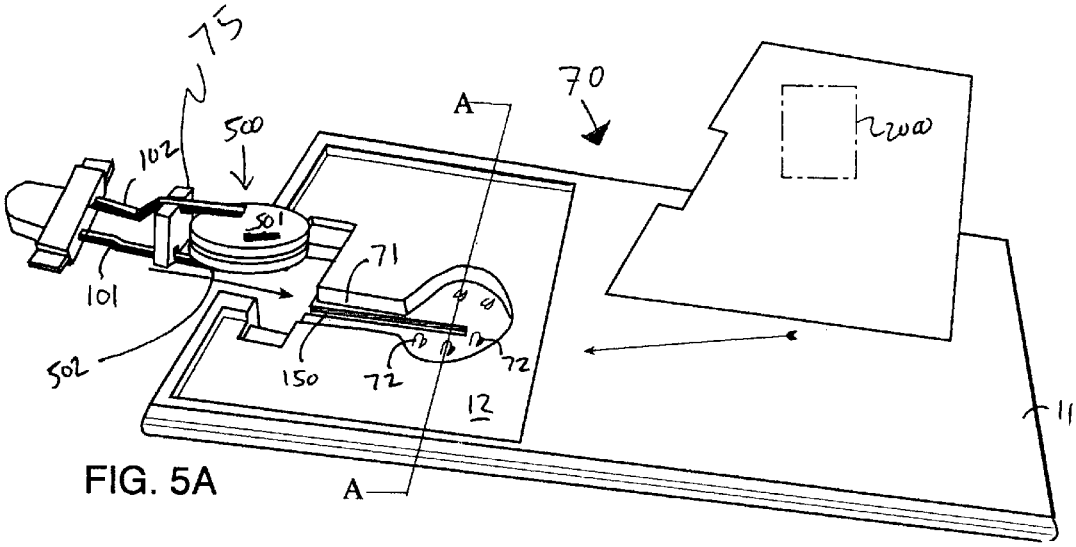
FIG. 5A
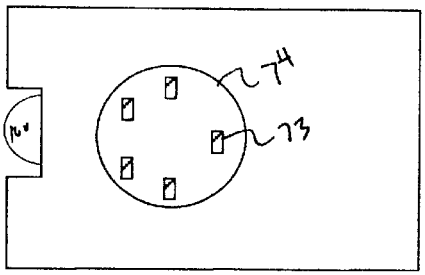
FIG. 5B
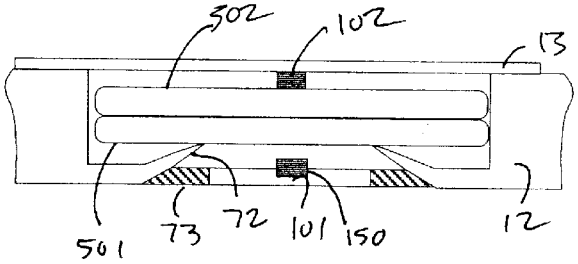
FIG. 5C
FIG. 5D
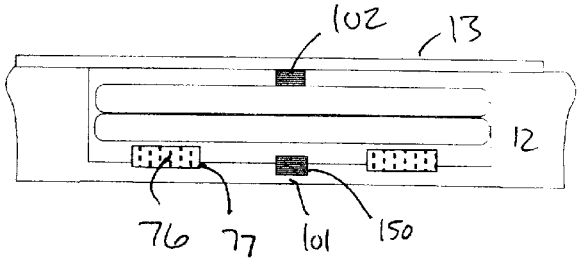

THIN FLAT ILLUMINATOR

RELATED APPLICATIONS

The invention claims the benefit, under Title 35, United States Code 119 (e), of Provisional Patent Applications: Ser. No. 60/202,894, filed May 10, 2000, entitled "Flat Illuminator" and, No. 60/253,188, filed Nov. 27, 2000, entitled "Side Switched Flat Illuminator" and is also related to Applicants' pending application filed Dec. 19, 2000, entitled "Side Switched Flat Illuminator" Ser. No. 09/740,472.

BACKGROUND OF THE INVENTION

1. Field of the Invention

This present invention relates to a miniature flat flashlight. More particularly to a plastic card light which illuminates with one or more light-emitting diodes, powered by a single or multiple battery power supply, which m ay also be integrated into either a flat key card, or credit card.

2. Related Arts

A recent card light is found in U.S. Pat. No. 6,070,990, assigned to the Eveready Battery Company which claims a single "button" battery and spacer, sandwiched between the anode and cathode of a circular LED as a simple switching mechanism. The circular LED protrudes beyond the top and bottom edges of the card light encasement.

The LED mount taught in the Eveready patent requires "forceful insertion of the LED leads in the holes" formed therein. The battery must be mounted during the forceful insertion of the LED lead wires through tiny holes while positioning a battery and spacer both within a cavity for holding the battery and between the two lead wires. A LED which may be quickly and easily mounted while already positioned on the battery, without "forceful" insertion of the LED or lead wires into a small hole is not taught or contemplated by the Eveready patent.

Another card light is shown in U.S. Pat. No. 6,109,762, issued to Hallgrimsson. The Hallgrimsson patent claims another card shaped flashlight which sandwiches an LED lead wire into a deformable plastic switch which may be lowered into contact with a single battery to switch "on" the power.

The Eveready and Hallgrimsson card lights are a small step towards an easily produced flat card light. However, to achieve efficient low cost production and/or increased illumination output, a card illuminator adapted for easy LED mounting, and which can accommodate one or more LEDs and multiple battery cells, while maintaining a thin profile, would be useful.

Plastic key blanks, formed integrally within the plane of a card are represented in the art. U.S. Pat. No. 4,677,835, issued to Almblad, teaches an integrated hinge element connecting a plastic key to a card thereby allowing the key to be displaced from the card and twisted. U.S. Pat. No. 5,046,343, issued to Miwa teaches an insert-molded key and flat card. The Miwa patent illustrates a hinge pin, insert molded into a flat card and used as the pivot point, whereby the key may be rotated out of plane with the card. Another key card, which provides a key connected to the card in a movable fashion, is taught in U.S. Pat. No. 5,544,510 issued to Botteon. The Botteon patent also suggests the placement of bar codes, alpha numeric coding,and the use of a magnetic strip, which can store readable data.

SUMMARY OF INVENTION

The invention herein is a thin credit card flashlight. In some embodiments the card light is no thicker than the LED.

The card light may be disposable with the battery supply fixed within a battery and LED receiving chamber by adhesive, sonic weld, glue, or other substantially permanent fixing agent under a chamber cover; or the card light may have a replaceable battery source held in place under a removable chamber cover. A momentary on/off switch is integrated within the device. Certain terminology will be used in the following specification,for convenience and reference and not as a limitation, brief definitions are provided below:

A. "Button battery " or "button batteries" as used herein refer to one or more coin-type battery including but not limited to batteries containing lithium, and with a thickness of between about 0.2.5 and about 3.0 millimeters and a diameter of between about 10 and about 40 millimeters.

B. "LED" as used herein refers to a light emitting diodes, circular, oval, square, flat, rectangular and flat. LED also includes, but is not limited to, those light emitting diodes which produce a constant output or a blinking output, in a narrow wavelength associated with a specific spectral region, (visible or non-visible) such as red light, blue light, or yellow light, IR, UV and those which produce a wide spectrum output comprising more than one distinct spectral region of light.

C. "Data storage region" as used herein refers to barcodes, a magnetic datastrips, optical strips, 2D data matrix symbologies, holograms, holographs, dataglyphs, serial numbers, alpha numeric symbols, symbols, and characters.

D. "Representational material" as used herein refers to information, picture, graphics, codes, glyphs, icons, trademarks, logos, visual patterns, art, photographs, digital images, promotional literature, symbols or characters.

In some embodiments the LED cathode and anode lead wires comprise the momentary switch, with one lead positioned in-line but remote from the battery supply. The remote lead is separated from the battery supply either by a spacer or integral body spring, until the spacer or integral spring is deformed under pressure thereby switching "on" the current. In other embodiments either the anode or cathode lead is off-set from the battery supply and a conductive member, either mounted to the chamber cover or held above the offset lead wire, is used to connect the battery supply to the LED.

Promotional material may be stenciled onto the flat card light (FIGS. 1E and 2C) plastic keys may be integrated into the card light housing forming a combined card light and key holder (FIG. 3). The card light may also be integrated into a credit card assembly to provide a combination light and credit card (FIG. 4).

A unique tabbed LED (FIG. 1A) has also been developed for this card light. The tabbed LED forms a latch which mates with a catch on the card light casing. The direct mount of the LED to the casing, without having to insert lead wires through holes, allows for rapid assembly and simplifies battery placement and switch assembly.

The features of the invention believed to be novel are set forth with particularity in the appended claim. The invention itself, however, both as to configuration, and method of operation, and the advantages thereof, may be best understood by reference to the following specification, abstract, claims and accompanying drawings.

BRIEF DESCRIPTION OF THE DRAWINGS

FIG. 3 is a top view a fourth alternate embodiment of the card light with.

FIG. 5A is a sixth alternate embodiment of the card light with integrated riser spring.

FIG. 5B is a bottom view of the embodiment of FIG. 5A.

FIG. 5C is a cut-away view along the line of "A—A" of FIG. 5A.

FIG. 5D is a cut-away view of an alternate spring for the embodiment of FIG.

MODES FOR CARRYING OUTTHE PREFERRED EMBODIMENTS OF THE INVENTION

Figure 1A:
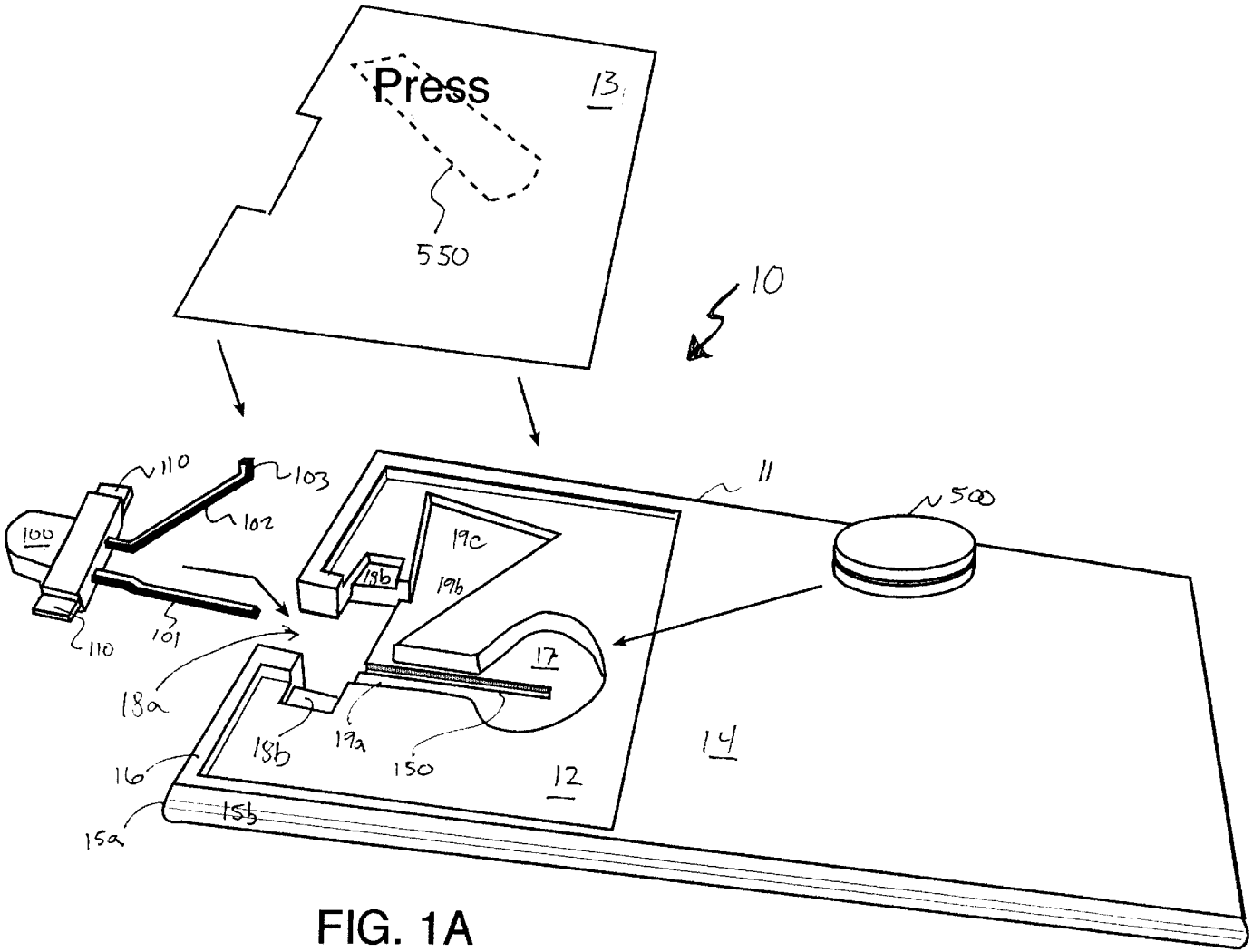
FIG. 1A is an assembly view of the preferred embodiment of the card light.

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for claims and as a representative basis for teaching one skilled in the art to variously employ the present Invention in virtually any appropriately detailed structure.

The preferred embodiment of the card light (FIGS. 1A–1D)generally designated 10, is constructed on a substantially planar semi-rigid plastic body 11 with a battery supply and LED receiving chamber 12 formed therein, and with a chamber cover 13 which mates over the battery supply and LED receiving chamber 12 A non-exhaustive list of plastics which the plastic body 11 may be constructed of include ABS, vinyl, polypropylene, polycarbonate, ABS with stiffening additives, rubberized ABS, and/or polyethylene.

The chamber cover 13 should be constructed of a material which is both adequately flexible to allow deformation and adequate memory to return to the non-deformed state. A non-exhaustive list of suitable construction materials for the chamber cover 13 include coated paper, plastic rubberized plastic, silicone, rubber, impregnated paper, polypropylene, vinyl, polyethylene, ABS, styrene, polycarbonate, laminated paper, Mylar, a or any suitable multi-layer laminate. The chamber cover 13 may be textured on its surface to distinguish top from bottom, direct the user to the momentary switch, and/or provide a reflective-like surface. The chamber cover may be substantially clear with printing adhered to its back side (which will reduce rub-off) and viewed through its front-side. The chamber cover may be textured on its surface to reflect light. The chamber cover may be a multi-layered laminate with printed material laminated between one more layers.

An optional inactive portion 14 of the planar plastic body 11 may be formed adjacent to the battery supply and LED receiving chamber 12 The planar plastic will preferably have an edge 15*a* with a thickness between about 0.85 mm and about 3.5 mm. The edge 15*a* may be tapered, rounded, or beveled 15*b* around some or all of its periphery. A boundary surrounding the battery supply and LED receiving chamber 12 is defined by a ridge 16 which rises above the battery supply and LED receiving chamber 12 by about the thickness of the chamber cover 13.

Formed as a part of the battery supply and LED receiving chamber 12 is a battery holster 17 which is adapted to accept the power supply for the card light, shown in this embodiment as button batteries 500. Also within the battery supply and LED receiving chamber 12 is a LED mount 18*a*, of a size and shape to accept the selected LED 100. In this preferred embodiment the LED 100 may have mounting tabs 110 extending from, or affixed to, its sides which are useful to facilitate fast and accurate placement and mounting of the LED 100 within the tab guides 18*b* of the battery supply and LED receiving chamber 12. However, a flat LED, similar to the "HSMx-C1110/170/190/C191 High Performance Chip-LED" manufactured by Agilent Technologies, Inc., or the "ESM-3070" series LED, manufactured by Elekon Industries, in Torrance, Calif. may also be affixed within the LED mount 18*a*. Moreover, the specification of a flat LED is not intended as a limitation on the scope of the invention, a circular light emitting diode such as the HLMA-QH00-UW001 "Subminiature High Performance AllnGAP LED lamps" manufactured by Agilent Technologies (FIG. 1C), or an oval shaped LED such as the IHD 2651 or the IGD 2651 "2×3 mm Oblong" manufactured by IDEA, Inc., in Brea, Calif. may be substituted for the flat LED called out for.

Figure 1B:
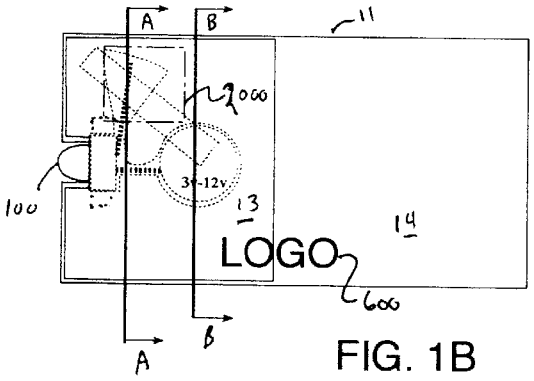
FIG. 1B is a top view of the embodiment shown in FIG. 1A.
Figure 1C:
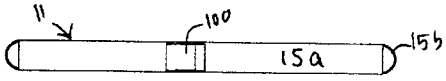
FIG. 1C is a front rear view of the embodiment shown in FIG. 1A.
Figure 1D:
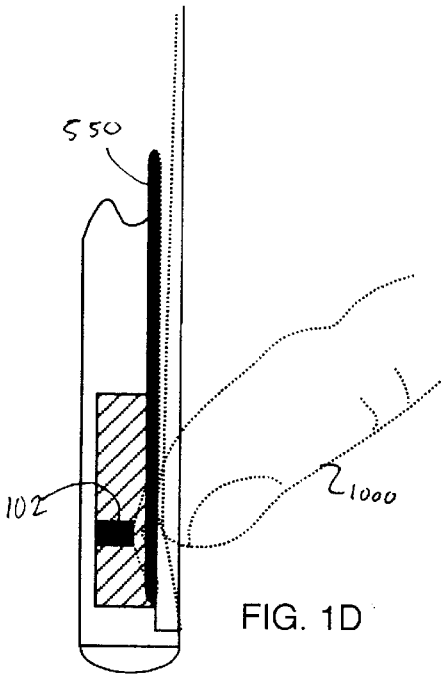
FIG. 1D is a cut-away view, along the line of "A"—"A" of the embodiment shown in FIG. 1B.

Formed in the planar body 11 extending from, and connected to, the LED mount 18*a* is a first LED lead wire channel 19*a* through which the cathode 101 lead wires extend to the battery holster 17. Also formed in the planar body 11 is a second LED lead wire channel 19*b* through which the anode lead wire 102 extends into a switching channel 19*c*, also formed in the planar body 11 which forms part of the momentary switch for the card light (FIG. 1D).

To complete the assembly of the card light 10 two button batteries 500 are inserted into the battery holster 17 on top of, and conductively in contact with, the cathode lead wire 101. A contact strip 550 is affixed to the underside of the chamber cover 13 and positioned to conductively mate with the top of the button batteries 500 and sit remotely above the anode lead wire 102 when the chamber cover has been affixed above the battery supply and LED receiving chamber 12 and within the boundary formed by the ridge 16. The contact strip 550 may be a conductive foil held to the chamber cover 13 by adhesive. The contact strip 550 may also be formed as a conductive portion of a layer forming the chamber cover 13, a conductive ink printed on the chamber cover, or a thin conductive wire. The contact strip should be no thicker than about 1 millimeter, preferably between about 0.20 and about 0.75 millimeters and most preferably less than about 0.20 millimeters A suitable battery supply may include one or more of the Poly-carbonmonofluoride (BR series) lithium batteries or the Manganese dioxide (CR series) lithium batteries either with a height, preferably of 3 mm or less, manufactured by Matsushita Electric Corporation of America (Panasonic).

The above examples of button batteries are not an exhaustive list of possible power supplies, nor is the above list intended to act as a limitation on the doctrine of equivalents. A flexible flat power supply manufactured by Paper Power in Israel, (FIG. 6) may be adapted as a power supply, dependent on the current and amperage requirements of the selected LED.

It is also within the intended scope of this invention that as few as one and as many as 12 button batteries may be substituted in place of the two button batteries shown. It is within the scope of this invention that any battery or combination of batteries with the appropriate size and current characteristics could be substitutes for the button battery or power supply called out for. The choice of the power supply, button battery or button batteries for a particular card light will be dependent on the number of LEDs being powered, the current requirements of the LED(s) and the intended usage of the card light.

To switch "on" the card light 10 the user 1000 merely press down on the chamber cover 13, at the switch region 2000, thereby urging the contact strip 550 downward into the switching channel 19*c* and against the anode lead wire 102 connecting the LED too to the button battery 500.

Not shown is the release of the switch region 2000 and the return of the chamber cover 13 to its non-distorted shape. A lead support region 103 which buttresses the anode lead wire 102 against the chamber cover 13 may also be added whereby the anode lead wire 102 is urged against the bottom of the second LED lead wire channel 19*b* thereby reducing the occurrence of accidental switching "on" of the card light via the anode lead wire 102 lifting up and making contact with the contact strip 550.

Figure 1E:
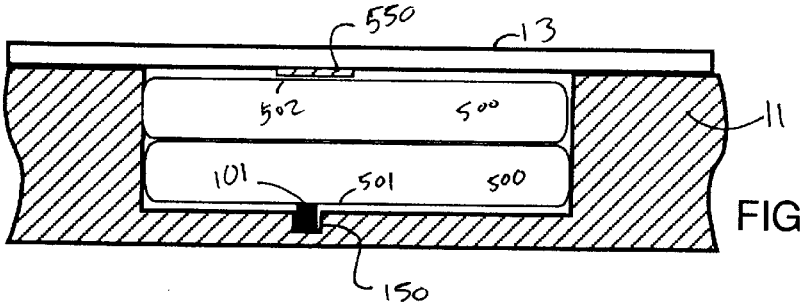
FIG. 1E is a cut-away view, along the line of "B"—"B" of the embodiment shown in FIG. 1B.

To maintain minimum card light thickness (FIG. 1E) the LED's cathode lead wire 101 may be placed within a lead lowering guide 150 thereby securing a portion of the cathode lead wire 101 within the bottom of the battery holster 17 while urging a small portion of the cathode lead wire 101 into contact with the first terminal 501 of the button batteries 500. The contact strip 550 rests on the second terminal 502 of the button batteries. To switch on the light, (FIG. 1D), the contact strip 550 is pressed into contact with the anode lead 102

Figure 1F:
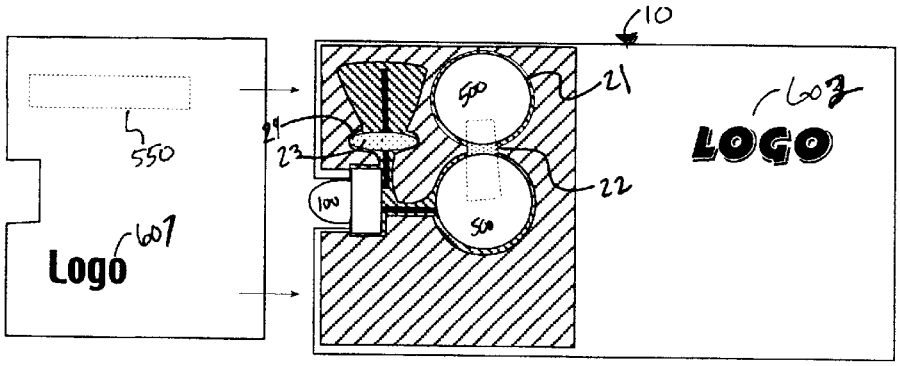
FIG. 1F is a first alternate embodiment of the card light with a side-by-side button battery power supply.

The card light 10 may contain a side-by-side battery power supply as illustrated in FIG. 1F. Within the a battery supply and LED receiving chamber 12 is formed an adjacent battery holster 21 with an auxiliary contact strip 22 conductively connecting the bottom of the battery holster 17 and the adjacent battery holster 21 in those card lights where the selected battery supply is multiple batteries with a height or thickness too great to allow stacking (FIG. 1A) within the battery holster 17, multiple batteries may be mounted within the planar body 11 by using the side-by-side configuration shown in FIG. 1F. To allow proper alignment of the contact strip 550 with both the button battery 500 and the anode wire lead 102 the placement of the contact strip 550 may be adjusted. A non-conductive spacer 23 may also be added within a spacer guide 24 to act as a fixture to urge the anode lead 102 downward against the plastic body. A logo 600, 601, 602 or other representational material may also be added to the surface of the planar body 11 and/or the chamber cover (FIGS. 1B and 1F). Multiple LEDs 100 may also be placed within a card light.

Figure 1G:
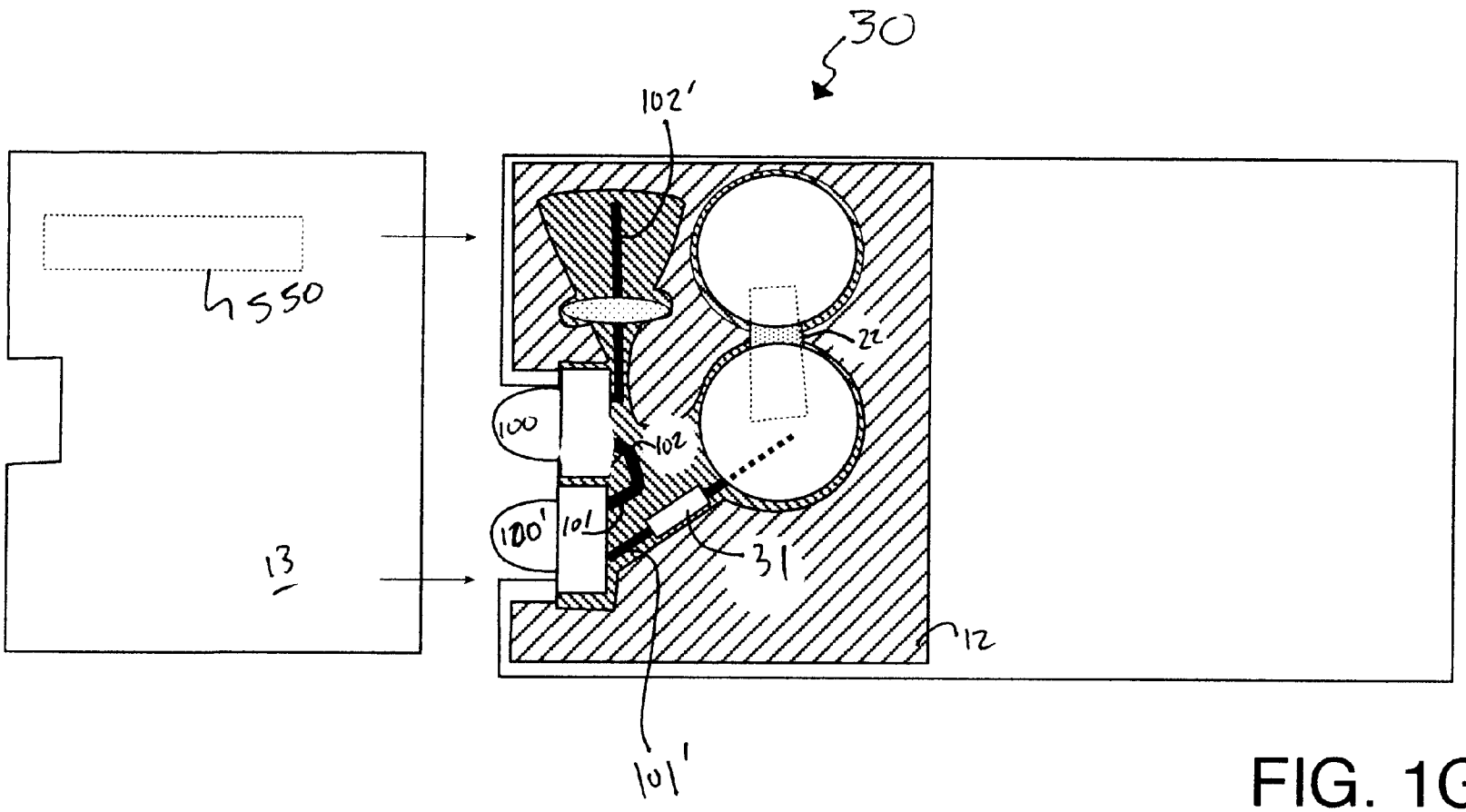
FIG. 1G is a second alternate embodiment of the card light with a side-by-side button battery power supply.

Shown in FIG. 1G is a two LED card light, generally designated 30. The two LEDs 100 & 101' are connected by the cathode 101 of the first LED 101 to the anode 102 of the adjacent LED 101'. A resistor 31 may be placed between the batteries and LED in the circuit to control the current supplied to the LEDs. The remainder of the two LED card light 30 is constructed according to the embodiment illustrated in FIG. 1F.

Figure 2A:
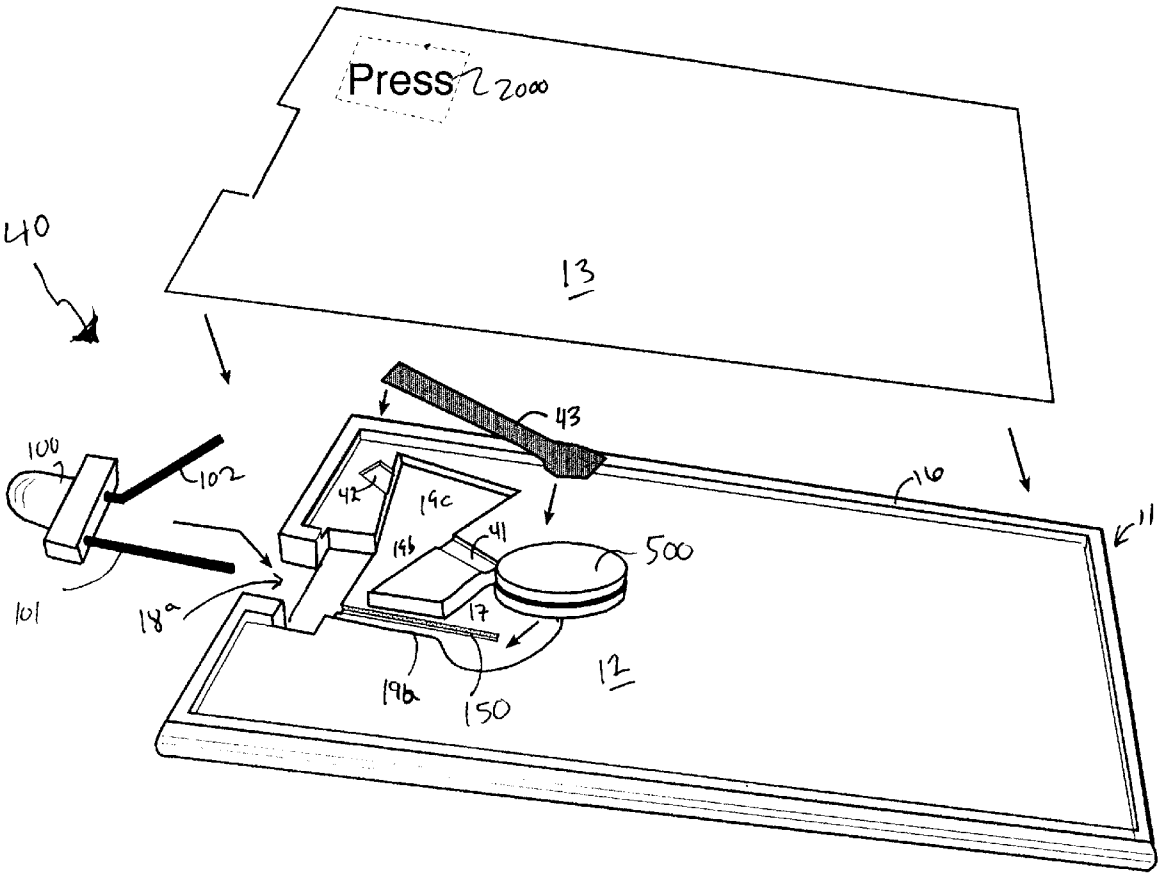
FIG. 2A is an assembly view of the third alternate embodiment of the card light.
Figure 2B:
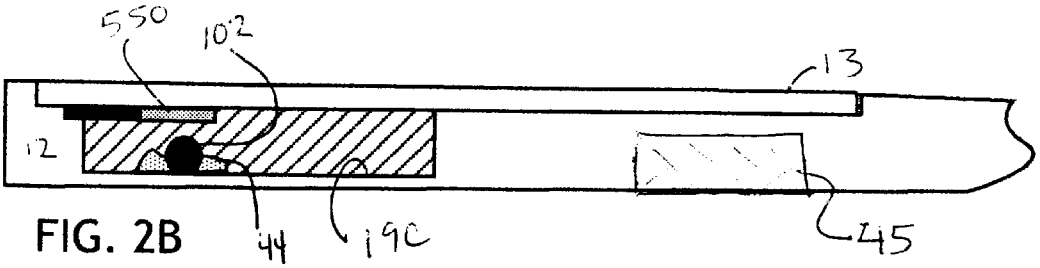
FIG. 2B is a cut-away view, at the momentary switch of the embodiment shown in FIG. 2A.

Another alternate embodiment is illustrated in FIGS. 2A & 2B which is constructed on the planar plastic body 11 of the preferred embodiment 10, and generally designated 40. In this embodiment the battery supply and LED receiving chamber 12 is enlarged to extend over substantially all of the top surface of the plastic body 11, a first switching strip guide 41 and a second switching strip guide 42 are formed.

During assembly (FIG. 2A) of the card light a resilient, conductive and flexible switching strip 43 is placed in conductive contact over the button battery 500 and supported above the anode lead wire 102, within the first and second switching strip guides 41 and 42. To complete the assembly the chamber cover, of a size corresponding to the battery supply and LED receiving chamber 12 is affixed over the battery supply and LED receiving chamber 12. A measure of non-conductive fixture material 44 such as silicone, rubber or epoxy (FIG. 2B) may be added to the end of the anode lead 102 to urge the anode lead wire 102 to remain against the bottom of the plastic body 11. Those skilled in the art will realize that other materials such as rubber or plastic spacers, pliable plugs, hard plugs or tape may serve the equivalent function of the globular material 44. One or more magnets 45 may be affixed through the pastels body which will enable the card light to be attached to a an appropriate surface.

Shown in this embodiment is a circular LED 100. Two circular LED suitable for use are the "HLMA-QH00-UW011 Subminiature High Performance AllnGAP LED lamps" manufactured by Agilent Technologies, or the"KM2520xxx001,002 or 003 Subminiature Solid State Led Lamps, manufactured by King Bright. Multiple LEDs, oval shaped LEDs, and flat or side emitting LED may also be utilized in lieu of the circular LED illustrated.

To switch "on" the card light 40 the operator (not shown) merely depresses the pre-selected switch region 2000 on the surface of the chamber cover 13, and the switching strip 43 is momentarily placed in contact with the anode lead wire 102 thereby switching on the LED 100.

Throughout this specification, the terms anode and cathode are used interchangeably, by simply reversing the battery terminal connections those skilled in the art will realize that the connection of the LED may be reversed in such a fashion. Any such configuration changes are anticipated by and within the scope of this invention.

Figure 3:
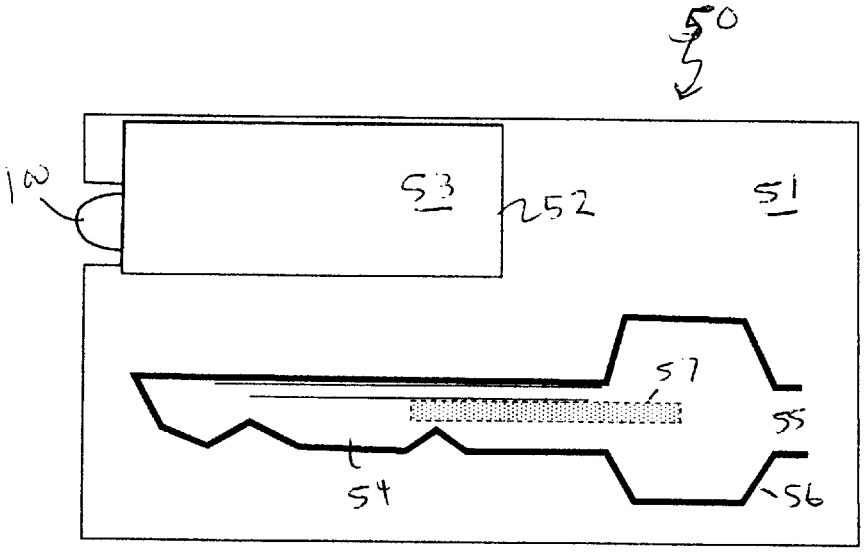

FIG. 3 illustrates a combination plastic key and card light is shown, generally designated 50. Within the plastic planar body 51, of a thickness between about 1 millimeter to about 3.5 millimeters, a battery supply and LED receiving chamber 52 is formed that contains a battery power supply, an LED 100 and a switch (not shown) and is covered with a corresponding chamber cover 53.

A key blank 54 and flexible support 55 movably nest within a key guide 56 formed in the planar body 51. The planar body 51 and key blank 54 are formed out of a material with adequate durability to allow a particular key pattern to be reproduced on the key blank 54 with common key making equipment used in the normal course and scope of the key cutting industry. A key skeleton 57, of a material more rigid than the planar body 51, may be co-molded or insert molded as part of the key blank 54.

Figure 4:
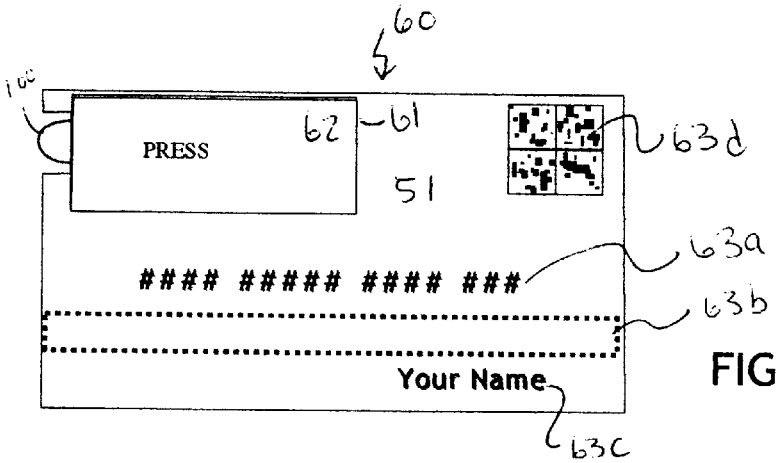
FIG. 4 is a top view of a fifth alternate embodiment of the card light.

In FIG. 4 a card light with one or more data storage regions is shown, generally designated 60. Within the plastic planar body 51, of a thickness between about 1 millimeter to about 3.5 millimeters, a battery supply and LED receiving chamber 61 is formed that contains a power supply, an LED 100 and a switch (not shown). A corresponding chamber cover 62 is affixed over the battery supply and LED receiving chamber 61. A data storage region containing raised alpha numeric characters, or alpha numeric characters, corresponding to a name, code sequence or account number 63*a*, may be imprinted, stamped or otherwise formed as part of the plastic planar body 51. Other Data storage regions including, but not limit to, a magnetic strip 63*b*, a name 63*c* and a data matrix 63*d* which may be read visually, magnetically, and/ or optically may also be affixed to, or formed as part of, the flat illuminator.

Another alternate embodiment of the card light is illustrated in FIGS. 5A–5C which is also constructed on the planar plastic body 11 of the preferred embodiment 10, and is generally designated 70. Within the battery supply and LED receiving chamber 12, a unitary lead guide 71 is formed through which both the cathode 101 and the anode 102 leads extend. At the bottom of the battery holster 17 are spring risers 72 formed integrally as part of the planar plastic body 11. A lead lowering guide 150 may also be added within the battery supply and LED receiving chamber 12 whereby the lower lead wire of the LED, the cathode lead wire 101 in this embodiment (FIG. 5C), is placed and supported beneath the bottom terminal 502 of the button batteries 500. The button batteries 500 are sandwiched between the cathode lead wire 101 and the anode lead wire 102. The LED and batteries (FIG. 5A) are then mounted within the planar plastic body 11. The anode lead wire 102 is in conductive contact with the batteries 500 top terminal 501

To form the switch one or more integral spring risers 72 are formed as part of the planar body 11. Riser channels 73 which may be formed (FIG. 5B) if the spring risers 72 were integrally formed during molding of the planar body 11 may be covered with an adhesive label or tape 74 to seal off the interior of the card light.

To switch "on" the LED 100 an operator presses on the switch region 2000 of the chamber cover 13 until the spring risers 72 compress and the bottom of the bottom terminal 502 contacts with the cathode lead wire 101 thereby providing current to the LED. A foam-like spacer 75 may be placed between the cathode lead wire 101 and the anode lead wire 102 which will act as a non-conductive fixture to urge the cathode lead wire 102 downward and against the bottom of the battery holster 17.

In FIG. 5D riser spring risers 72 of FIG. 5A are replaced with a softnon-conductive washer 76 resting in a washer seat 77. Pressure applied to the chamber cover 13 both maintains the contact between the anode lead wire 102 and the top terminal 501 of the battery supply and urges the bottom terminal 502 of the batteries 500 into contact with the cathode lead wire 101.

Figure 5E:
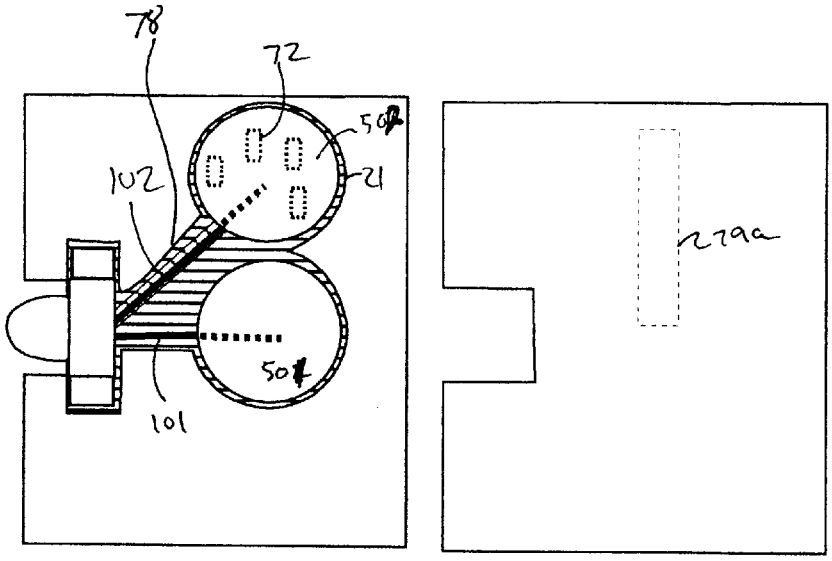
FIG. 5E is a top view of a seventh alternate embodiment of the card light.
Figure 5F:
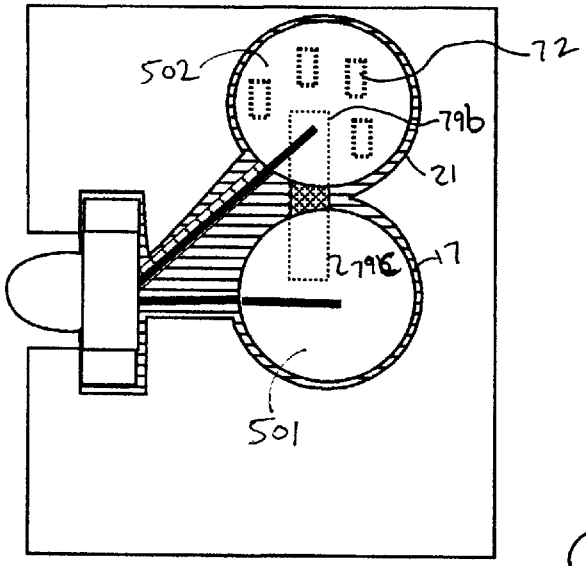
FIG. 5F is top view of an alternate component arrangement of the embodiment of FIG. 5E.
Figure 5G:
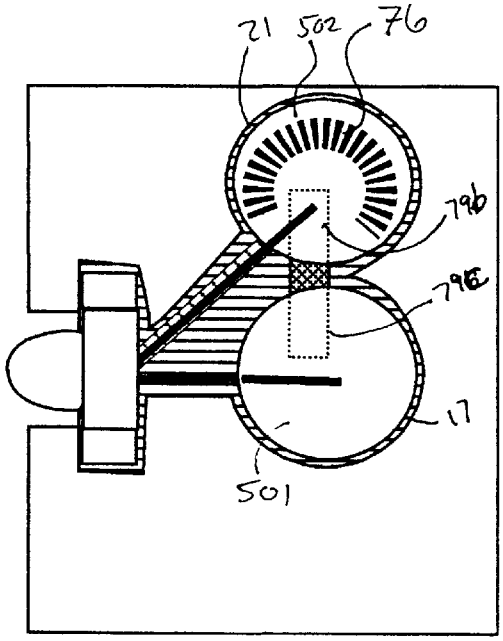
FIG. 5G is top view of another alternate component arrangement of the embodiment of FIG. 5E.

In FIGS. 5E–5G are illustrated the battery supply and LED receiving chamber 12 of additional side-by-side battery embodiments for the flat card light 70, all of which incorporate an auxiliary battery holster 21 adjacent to the battery holster 17. At least two batteries 500 are conductively linked in these embodiments. The momentary switch is formed by the controlled movement of a battery. An auxiliary lead guide 78 is formed into which either the cathode lead wire 101 or the anode lead wire 102 is placed.

In FIG. 5E the cathode lead wire 101 is placed beneath the battery in the battery holster 17 and the anode lead wire 102 is placed beneath the battery in the auxiliary battery holster 21. The battery in the auxiliary battery holster 21 is held remote from the anode lead wire 102 by spring risers 72, or by a soft non-conductive washer 76 (FIG. 5B). A contact strip 79*a* affixed to, or held in place by, the chamber cover 13 conductively links both groups of button batteries in the battery holster 17 and in the auxiliary battery holster 21. When pressure is applied (not shown) to the battery held in the auxiliary battery holster 21, its bottom terminal 502 is urged against the anode lead wire 102 below thereby switching "on" the LED.

In FIGS. 5F and 5G, the first end 79*b* of the contact strip 79*a* is placed beneath the battery in the battery holster 17 and the second end 79*c* of the contact strip 79*a* is placed beneath the battery in the auxiliary battery holster 21. The battery in the auxiliary battery holster 21 is held remote from the second end 79*c* by spring risers 72 or by a soft non-conductive washer 76, The chamber cover 13 holds both the anode lead wire 102 conductively to the top of the battery held in the auxiliary battery holster 21 and the cathode lead wire 101 to the top of the battery held in the battery holster 17. When pressure is applied (not shown) to the battery held in the auxiliary battery holster 21 its bottom terminal 502 is moved into contact with the first end of the contact strip 79*b* beneath it thereby switching "on" the LED.

Figure 6:
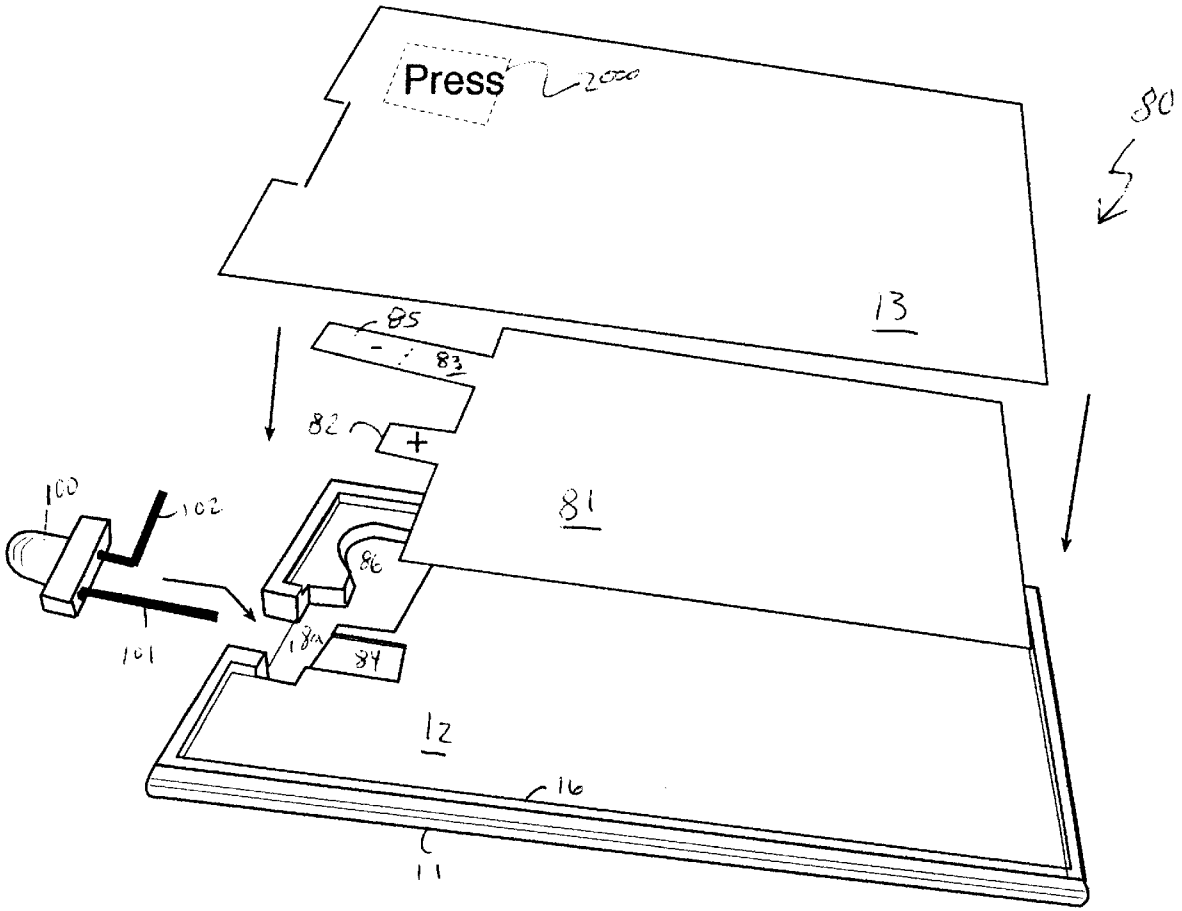
FIG. 6 is an assembly view of an eighth alternate embodiment of the card light.

FIG. 6 shows an assembly view of a card light 80 with a plastic planar body 11, a LED 100 within a LED mount 18*a*and a power supply and LED receiving chamber 12 adapted to accept a flat power supply 81 which has a forward facing first terminal 82 and second terminal 83. The first terminal 82 is in contact with the cathode lead wire 101 resting in a cathode lead guide 84. A conductive strip 85 (which forms a portion of the "on/off" switch) may be integrated into, or affixed to, the flat power supply's second terminal 83. The battery supply and LED receiving chamber 12 is defined by a ridge 16 which rises above the battery supply and LED receiving chamber 12 by about the thickness of the chamber cover 13 and the flat power supply 81.

To switch the card light 80 "on" the conductive strip 85 is urged downward into the switching channel 86, by an operator pressing on the switch region 2000, which in-turn directs the conductive strip 85 into momentary contact with the anode lead wire 102 thereby supplying current to the LED 100. To urge the conductive strip 85 to move with the chamber cover 13 it may be affixed thereto, constructed of a material with adequate memory to return to an undistorted state or combined with an appropriate spacer.

In any multiple LED configuration, such as that shown in FIG. 1G the characteristics of the LEDs such as fan angle and wavelength may be similar or dissimilar. In some instances dissimilar fan angles may provide a light with a flood and spot illumination. Dissimilar wavelengths may provide illumination which benefits from the destructive and/or constructive interference of the dissimilar wavelengths.

Since certain changes may be made in the above apparatus without departing from the scope of the invention herein involved, it is intended that all matter contained in the above description, as shown in the accompanying drawing, the specification, and the claims shall be interpreted in an illustrative, and not a limiting sense.

We claim:

1. A LED illuminator comprising;

a flat substantially planar plastic body with an edge;

a chamber formed within the plastic body to receive a button battery power supply;

a LED mount formed through a portion of the plastic body;

a button battery power supply within the chamber with a first and a second terminal;

at least one LED seated within the LED mount with a first lead wire in conductive contact with the first terminal and a second lead wire;

a switching channel, remote from the battery power supply, into which the second lead wire extends;

a flexible contact strip conductively affixed to the second terminal and extending above the second lead wire; and, a flexible chamber cover which closes off the chamber, whereby pressing on the chamber cover will urge the flexible contact strip into contact with the second lead wire thereby supplying current to the LED.

2. The flat illuminator of claim 1, wherein the flexible contact strip is a conductive foil or ink affixed to the bottom face of the chamber cover.

3. The flat illuminator of claim 1, wherein the flexible contact strip is a conductive member of adequate integrity to be self supporting, and further comprising a strip guide formed across the top of the switching channel adapted to maintain the position of the flexible contact strip.

4. The flat illuminator of claim 1, further comprising:

One or more mounting tabs extending from the base of the LED; and,

One or more tab guides formed as part of the LED mount and adapted to receive the one or more LED tabs.

5. The flat illuminator of claim 1, further comprising;

a battery holster to receive a battery power supply formed within the chamber;

a first lead wire channel extending from the base of the LED to the battery holster; and, a second lead wire channel extending from the base of the LED into the switching channel.

6. The flat illuminator of claim 5, further comprising a lead lowering guide formed within the first lead wire channel extending from the base of the LED to within the battery holster, whereby the first lead is both partially recessed beneath the floor of the first lead channel.

7. The flat illuminator of claim 5, further comprising a lead support region formed as part of the second lead wire which is positioned to buttress against the chamber cover to urge the second lead wire downward in the chamber.

8. The flat illuminator of claim 5, further comprising a non-conductive fixture placed over a portion of the second lead wire, whereby the second lead wire is urged against the plastic body.

9. The flat illuminator of claim 1, further comprising a resistor placed in the electrical circuit between the battery power supply and the LED.

10. The flat illuminator of claim 1, wherein the chamber cover is a laminate which may have representation material within it and with substantially clear material above the representation material adapted to allow the representational material to be viewed through its top surface.

11. The flat illuminator of claim 1, wherein the chamber cover is a substantially clear material which may have representational material affixed or printed into its bottom surface which may be viewed through its top surface.

12. The flat illuminator of claim 10, wherein the chamber cover is textured.

13. The flat illuminator of claim 1, wherein representational material is printed on one or more portions of the outer surface of the plastic body.

14. The flat illuminator of claim 1, further comprising;

a key guide;

a key blank adapted to be machined as a lock specific key adapted to nest within the key guide when not in use; and, a flexible support connecting the key blank to the key guide adapted to allow the key blank to be displaced from the key guide.

15. The flat illuminator of claim 1, further comprising one or more areas of data storage.

16. The flat illuminator of claim 1 further comprising one or more magnets affixed within the plastic body.

17. The flat illuminator of claim 1, further comprising:

An auxiliary battery holster formed within the chamber;

an additional button battery power supply placed within the auxiliary battery holster; and, an auxiliary contact strip to connect the battery power supply and the additional battery power supply in series, wherein the second terminal is located on the auxiliary battery power supply.

18. A LED illuminator comprising;

a flat substantially planar plastic body with a an edge;

a chamber formed within the plastic body to receive a button battery power supply;

a battery holster with a side wall and with a floor formed within the chamber;

a LED mount formed within the chamber and extending through a portion of the edge of the plastic body;

a button battery power supply placed within the battery holster with a first and a second terminal;

a LED seat within the LED mount with a first lead wire in conductive contact with the first terminal and a second lead wire;

a channel into which the second lead wire extends and terminates within the bottom of the battery holster;

one or more lifting means are placed under the second terminal whereby the second terminal is held remote from the second lead wire;

a flexible chamber cover which closes off the chamber, whereby the one or more lifting means can be reversibly deformed, when the second terminal is urged downward against the second lead wire via pressing on the flexible chamber cover, thereby providing power to the LED.

19. The flat illuminator of claim 18, further comprising:

One or more mounting tabs extending from the base of the LED; and,

One or more tab guides formed as part of the LED mount to receive the one or more mounting tabs.

20. The flat illuminator of claim 18, further comprising a lead lowering guide formed within the unitary lead guide extending from the base of the LED to within the battery holster, whereby the second lead is partially recessed beneath the floor of the battery holster.

21. The flat illuminator of claim 18, further comprising a non-conductive fixture interposed between the second and first lead wires, whereby the second lead wire is urged against the plastic body.

22. The flat illuminator of claim 18, further comprising a resistor placed in the electrical circuit between the battery power supply and the LED.

23. The flat illuminator of claim 18, wherein the chamber cover is a multi-layered laminate which may have representation material laminated within it and with substantially clear layer(s) above the representation material adapted to allow the representational material to be viewed through its top surface.

24. The flat illuminator of claim 18, wherein the chamber cover is a substantially clear material which may have representational material affixed or printed into its bottom surface which may be viewed through its top surface.

25. The flat illuminator of claim 24, wherein the chamber cover is textured.

26. The flat illuminator of claim 18, wherein representational material is printed on one or more portions of the outer surface of the plastic body.

27. The flat illuminator of claim 18, further comprising;

a key guide;

a key blank adapted to be machined as a lock specific key which nests within the key guide when not in use; and, a flexible support connecting the key blank to the key guide adapted to allow the key blank to be displaced outwardly from the key guide.

28. The flat illuminator of claim 18, further comprising one or more areas of data storage.

29. The flat illuminator of claim 18, further comprising:

an auxiliary battery holster formed within the chamber;

an additional button battery power supply placed within the auxiliary battery holster; and, an auxiliary contact strip connecting across the top of the battery power supply and the additional battery power supply whereby all of the batteries are in series, and the second terminal is located on the auxiliary battery power supply.

30. The flat illuminator of claim 18, wherein the lifting means is one or more flexible plastic spring risers formed integrally within the plastic body.

31. The flat illuminator of claim 18, wherein the lifting means is a soft compressible non-conductive washer.

32. The flat illuminator of claim 18, further comprising;

one or more additional LED mounts; and, one or more additional LEDs, which may be dissimilar in fan angle and wavelength from the LED, connected in series with the LED, and with the first lead wire extending from the LED and the second lead wire extending from the last additional LED in the series.

33. A LED illuminator comprising;

a flat substantially planar plastic body with an edge;

a chamber formed within to receive a first and a second button battery power supply;

a battery holster to receive the first button battery power supply with a side wall formed within the chamber;

an auxiliary battery holster to receive the second button battery power supply with a side wall formed within the chamber;

a LED mount formed within the chamber and extending through a portion of edge of the plastic body;

a channel extending from the LED mount to the first and second botton battery holsters;

a first button battery power supply, placed within the battery holster, with a top facing first terminal and a bottom facing second terminal;

a second button battery power supply, placed within the auxiliary battery holster, with a bottom facing first auxiliary terminal and a top facing second auxiliary terminal;

an auxiliary contact strip adapted to sit beneath and in conductive contact with the second terminal and beneath the first auxiliary terminal;

a LED seated within the LED mount with a first lead wire in conductive contact with the first terminal its second lead wire in conductive contact with the top facing second auxiliary terminal;

one or more lifting means placed under the first auxiliary terminal above the auxiliary contact strip whereby the first auxiliary terminal is held remote from the auxiliary contact strip; and, a flexible chamber cover which closes off the chamber, whereby pressing on the flexible cover will urge the first auxiliary terminal downward against the auxiliary contact strip.

34. The flat illuminator of claim 33, wherein the lifting means is one or more flexible plastic spring risers formed integrally in the plastics body.

35. The flat illuminator of claim 33, wherein the lifting means is a soft compressible non-conductive washer.

36. The flat illuminator of claim 11, wherein the chamber cover is textured.

* * * * *